United States Patent [19]

Bisbing

[11] Patent Number: 4,597,599

[45] Date of Patent: Jul. 1, 1986

[54] BLIND LATCH

[75] Inventor: Robert H. Bisbing, Springfield, Pa.

[73] Assignee: Southco, Inc., Concordville, Pa.

[21] Appl. No.: 628,131

[22] Filed: Jul. 11, 1984

Related U.S. Application Data

[63] Continuation-in-part of Ser. No. 576,130, Feb. 2, 1984, abandoned.

[51] Int. Cl.[4] ..... E05C 1/12

[52] U.S. Cl. ..... 292/174; 292/DIG. 72; 292/DIG. 51

[58] Field of Search ..... 292/DIG. 72, DIG. 51, 292/341.14, 341.19, 175, 246, 174, 302, 333, 169 R, 176

[56] References Cited

U.S. PATENT DOCUMENTS

| | | | |
|---|---|---|---|
| 506,370 | 10/1893 | Miracle | 292/174 |
| 1,919,763 | 7/1933 | Allen | 292/333 X |
| 2,734,764 | 2/1956 | Angelo | 292/333 |
| 4,024,739 | 5/1977 | Kaufman | 292/341.19 X |
| 4,504,167 | 3/1985 | Nakanishi | 292/DIG. 72 X |

FOREIGN PATENT DOCUMENTS

| | | | |
|---|---|---|---|
| 1083426 | 1/1955 | France | 292/302 |

*Primary Examiner*—Richard E. Moore
*Attorney, Agent, or Firm*—Paul & Paul

[57] ABSTRACT

A blind latching system is disclosed for securing a closure element to a storage structure. The invention comprises a keeper sub-assembly, a cooperating latch sub-assembly and a release mechanism. The keeper sub-assembly is mounted in a fixed position for engagement by the latch sub-assembly which is affixed to and moves with the closure element. Movable first biasing means are provided for urging a latch into locked engagement with a keeper and a second movable biasing means is provided for maintaining a secure and rattle-free engagement of the closure element and the storage structure and to assist in opening the closure when it is unlatched. The first biasing means also urges the second biasing means against one end of a release rod to provide for its return to normal position after the unlatching action. The release rod may be a push rod for disengaging the latch from the keeper or a torque and cam operator for carrying out the same disengagement function.

10 Claims, 11 Drawing Figures

BLIND LATCH

This application is a continuation-in-part of application Ser. No. 06/576,130 filed Feb. 2, 1984 entitled Blind Latch, now abandoned.

BACKGROUND OF THE INVENTION

This invention relates to a blind latching system for cabinets or other similar storage structures in which a cabinet or the like is closed by means of a door or panel which will remain in closed position until released. One example of such a cabinet is a type used for housing electronic equipment. Heretofore, various latching devices for cabinet closures have been employed. For instance, an ordinary medicine cabinet has a hinged door which usually engages the cabinet proper by means of a friction type catch. However, the resulting combination of cabinet, door and latch is not suitable where it is desired to provide a door or panel which will resist an applied force when in closed position. Likewise, such friction type catches on doors and panels frequently have the disadvantage of not being rattle-free. The ideal closure system is one in which the panel or door is held securely and rattle-free under high load conditions and, likewise, is free of visible mounting hardware or actuating means on the front surface of the panel or door. In addition, such a latching system should be capable of relatively easy disengagement of the panel or door from its closed position. The desired combination is thus one which employs a simple push-to-close operation which results in a secure and rattle-free latching once the panel or door is moved to its closed position. Solving the problem of accomplishing all of this with latching means completely invisible from outside the cabinet when the panel or door is in the closed position is one of the principal objectives of the present invention.

SUMMARY OF THE INVENTION

The problems set forth above and the objectives referred to are substantially solved by the blind latching system of the present invention. This invention comprises two sub-assemblies, one of which is attached to the interior of a cabinet or similar enclosure and the other is attached to the interior surface of a panel, door or other closure member. These sub-assemblies are referred to hereinafter as a keeper sub-assembly and a latch sub-assembly, respectively, each of which includes a mounting bracket. In addition, there is provided a movable release rod which operatively engages a movable element forming a part of the latch sub-assembly. The movable release rod may be constructed and arranged to move either parallel to its own long axis or alternatively it may be constructed for rotational operation as hereinafter described.

The principal components of the keeper sub-assembly consist of an adjustable mounting bracket and an adjustable keeper pin having a flattened nose with tapered sidewalls which form a cam surface. This keeper pin, likewise, has a slot positioned behind the nose element and forward of a threaded cylindrical element which is adjustably positioned within an opening formed in the adjustable mounting bracket. Locking means for holding the keeper pin securely in position after it is adjusted are also provided.

The latch sub-assembly also has a mounting bracket having an opening for receiving the keeper pin, which pin is aligned with the opening by adjustment of the pin and its mounting bracket. The latching sub-assembly also is provided with a movable latch plate having a central opening for receiving the nose portion of the keeper pin. When this latch plate rides over the cam surface of the keeper pin, it ultimately drops into a groove formed in the keeper pin, thus providing a secure and rattle-free locking action when the panel or door is moved to a closed position. Biasing means are provided for urging the latch plate toward the keeper pin and, likewise, biasing means are provided for applying a force against a forward flat portion of the nose of the keeper pin.

Push rod means are provided for disengaging the latch plate from the groove of the keeper pin, thus making it possible to remove the closure panel or to open the closure door to gain access to the interior of the cabinet while at the same time providing a closure means which will resist external forces.

Alternatively the disengaging rod may be constructed for rotational movement which produces disengagement by means of a camming action.

A primary object of the present invention is to provide a blind latching system for firmly holding a panel or door closure when pushed to a closed position with respect to a cabinet or similar enclosure and at the same time to have nothing visible atany time on the front surface of the panel or door.

A further object of this invention is to provide a blind latching system which permits a simple push-to-close operation resulting in a latching action which is strongly resistant to any external force acting on the closure panel or door. A still further object is to provide a blind latching system having movable biasing elements to facilitate latching action with a keeper and to make it possible to disengage the latch from the keeper by movement of the biasing means through the action of a push rod or the like, or by a camming action causing a lifting of the latch means.

Other objects and advantages of this invention will be apparent from a study of the following Brief Description of the Drawings, the Detailed Description of the Invention, and the appended claims.

DETAILED DESCRIPTION OF THE INVENTION

Figure 1:
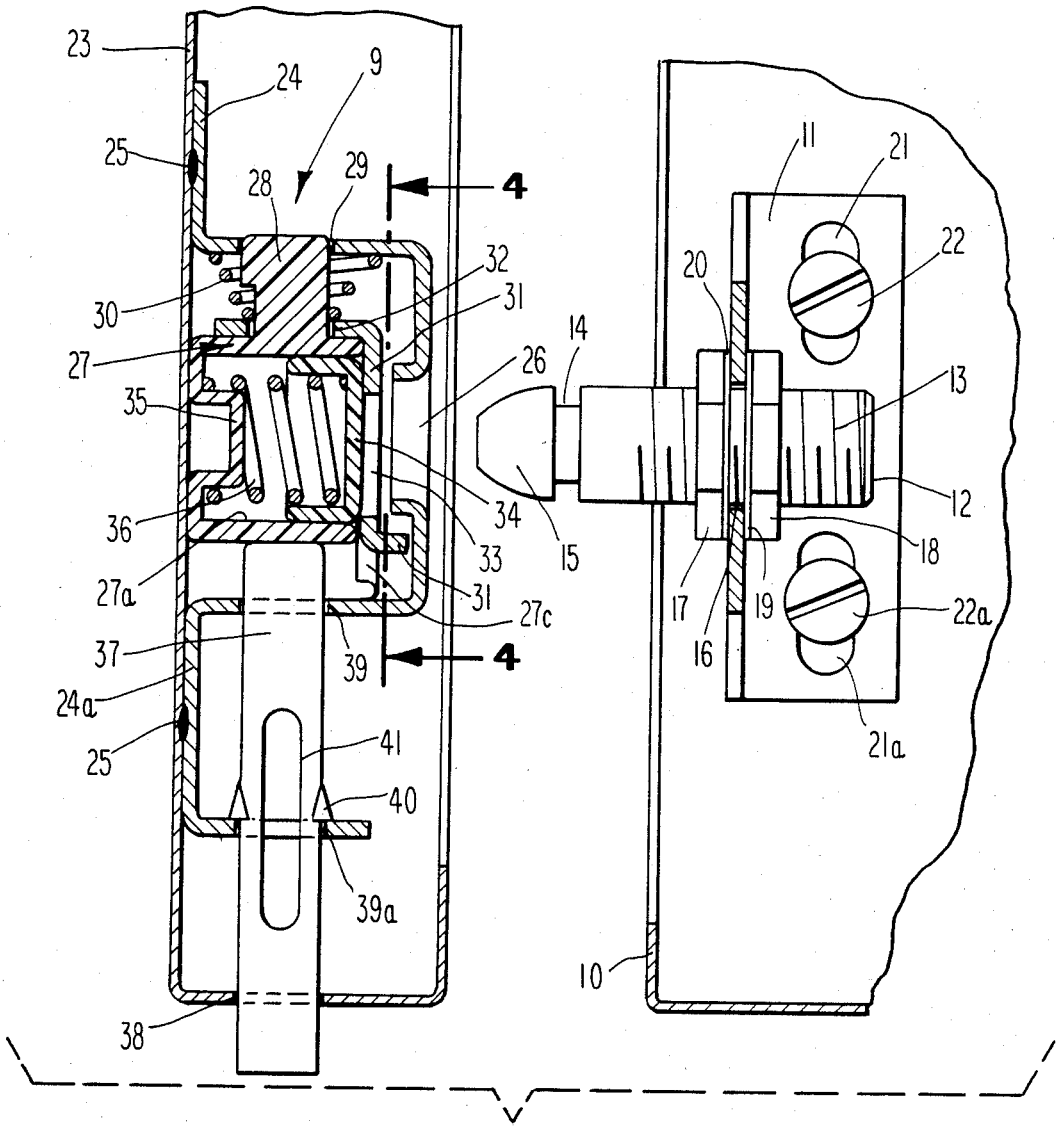
FIG. 1 is a cross-section through a cabinet and through a door shown in open position.

In FIG. 1 there is shown, in fragmentary cross-section, a cabinet 10 to which there is attached a mounting bracket 11. Mounted in an opening 16 provided in mounting bracket 11 is a keeper pin 12 having threads 13 formed in the shank thereof. Opening 16 is elongated in a direction perpendicular to the plane of the paper in FIG. 1 to provide two-way adjustment of pin 12 in opening 16. The forward end of keeper pin 12 has a nose element 15 terminating in a flat surface at its forward end for engagement with latch guide cup 34 of latch sub-assembly 9 when the closure 23 is moved toward its closed position. Curved sidewalls provide cam surfaces at the forward or nose portion of keeper pin 12 extending rearwardly and terminating in a groove 14 which is located immediately to the rear of nose element 15. Mounting nuts 17 and 18 and lock washers 19 and 20 serve as fastening means to hold keeper pin 12 firmly in fixed position in mounting bracket 11 after appropriate adjustment as hereinafter described. Slots 21 and 21*a* and screws 22 and 22*a* cooperate to provide an easy adjustment of the position of keeper mounting bracket 11 so that keeper pin 12 may be accurately aligned with opening 26 of mounting bracket 24 of the latch sub-assembly 9.

Keeper pin 12 is positioned in elongated opening 16 in bracket 11 and is locked in position after such positioning by means of threaded nuts 17 and 18 and lock washers 19 and 20. This positioning of keeper pin 12 in elongated opening 16 is carried out in such a way as to cause slot 14 to receive latch plate 31 when closure 23 is in a fully closed position with respect to cabinet 10.

Figure 2:
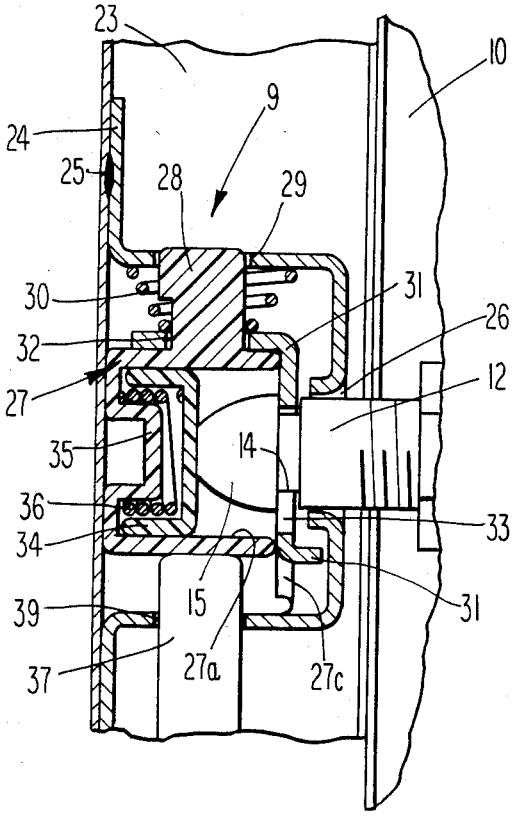
FIG. 2 is a cross-section similar to FIG. 1 showing the door in closed and latched position.

In the view to the left in FIG. 1 there is shown, in cross-section, a closure element 23 consisting of a panel or a door for closing the opening to cabinet 10. Firmly and immovably attached to the inner surface of closure 23 by means of welds 25 or the like is a mounting bracket 24 having four openings 26, 29, 39 and 39*a* which receive other structural or operative elements as hereinafter described. Positioned within mounting bracket 24 is a movable latch guide 27 having a stud 28 which extends into mounting bracket opening 29. Spring 30 is mounted on stud 28 and engages latch plate 31 at its upper surface. Latch plate 31 is provided with an opening 32 through which stud 28 extends, and likewise is provided with an opening 33 through which the nose 15 of keeper pin 12 extends when closure 23 moves to a closed position. Movably positioned within a cavity formed in latch guide 27 is a cup 34 which is engaged by the flat nose of keeper pin 12 as closure 23 is moved toward the closed position. Spring 36 is mounted on pedestal 35 and engages the inner surface of cup 34 to provide a biasing action urging cup 34 outwardly against keeper pin 12 so that latch plate 31 will be held snugly in groove 14 of keeper pin 12 after latch plate 31 drops into groove 14 when enclosure 23 moves to its closed position as shown in FIG. 2. This biasing force also serves to open door 23 when the closed door is unlatched. Release rod 37 is provided for disengaging latch plate 31 from groove 14 when it is desired to open enclosure means 23. In the embodiment of the invention shown in FIG. 1 release rod 37 is constructed of a yieldable plastic material and is provided with a slot 41 which gives sufficient flexibility to the rod 37 to move the stops 40 inwardly in order to insert or withdraw rod 37 through openings 38 and 39*a* on assembly or disassembly of the latch sub-assembly 9.

FIG. 2 of the drawings is a cross-section view of the latch sub-assembly 9 and a part of the keeper sub-assembly with the enclosure 23 in its fully closed position. In this figure the latch plate 31 has moved downwardly into the groove 14 in response to the bias force of spring 30. Likewise cup 34 has moved laterally against the bias of spring 36 in response to a force generated by movement of cup 34 against immovable keeper pin 12 which force has compressed spring 36 as shown. This action occurs on movement of closure 23 toward its closed position.

Figure 3:
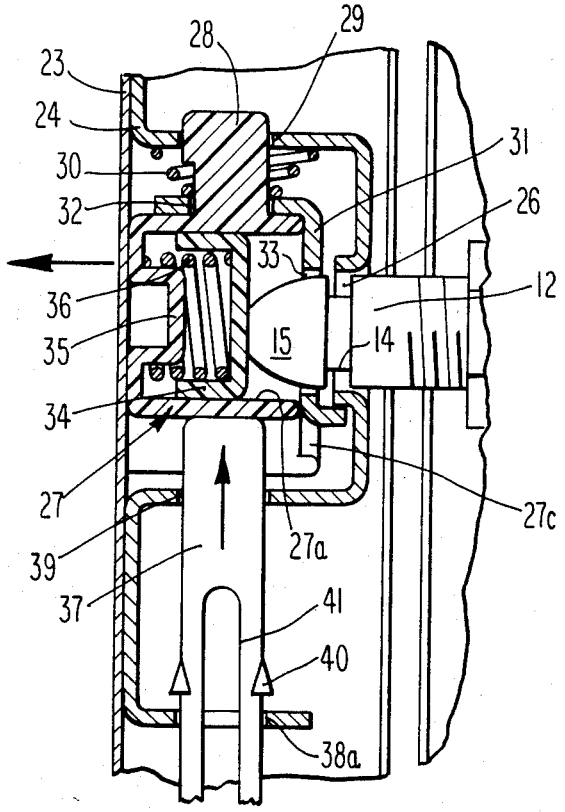
FIG. 3 is a view similar to FIG. 1 showing the door in a partly open position.

FIG. 3 is a cross-section of the latch sub-assembly and a part of the keeper sub-assembly showing the enclosure 23 in a partly open position and showing release rod 37 and the associated latch guide means 27 in the release position. In this embodiment of the invention release rod 37 is operated by depressing the end of release rod 37 where it projects through opening 38 in closure 23 as shown in FIG. 1.

Figure 4A:
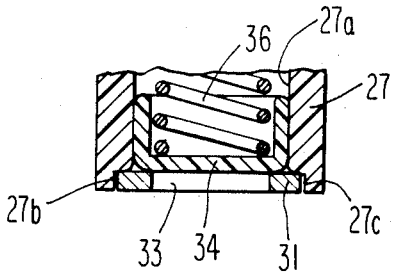
FIG. 4A is a sectional view taken along line 4A—4A of FIG. 4.
Figure 4:
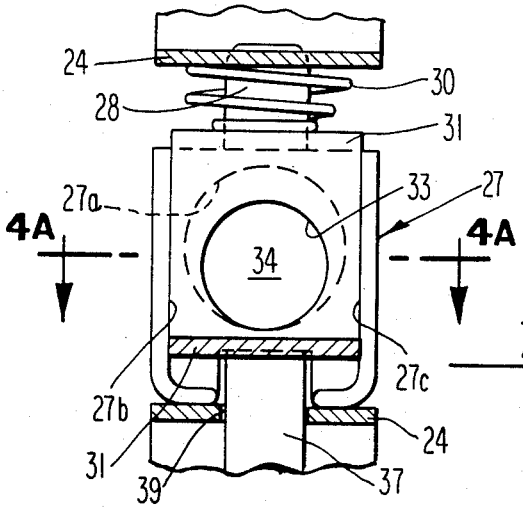
FIG. 4 is a sectional view taken along line 4—4 of FIG. 1.

FIG. 4 is a view partially in section taken through the line 4—4 of FIG. 1.

FIG. 4A is a cross-section view taken through the line 4A—4A of FIG. 4.

Figure 5:
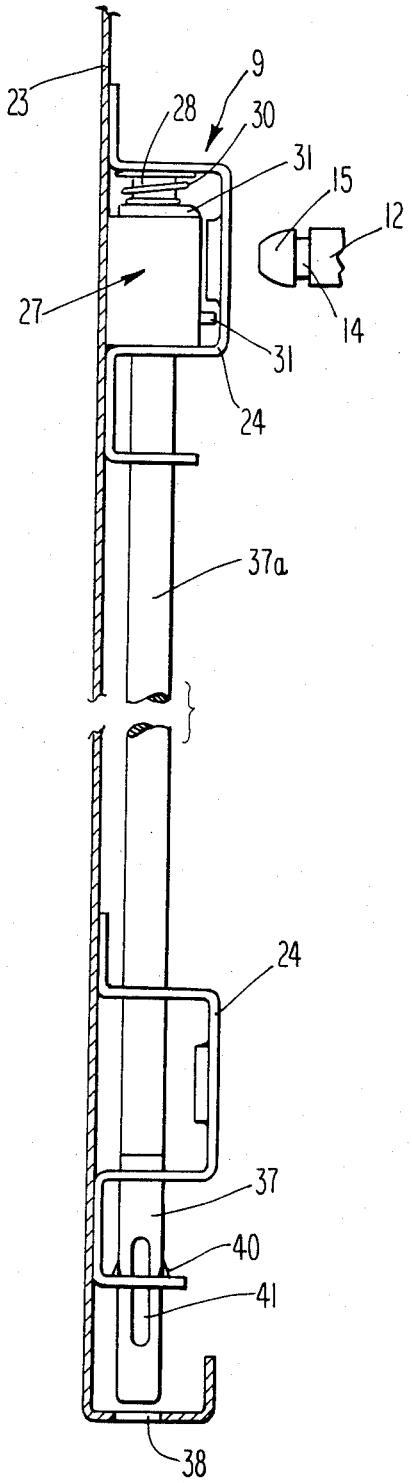
FIG. 5 is a sectional view of a modified form of the invention of FIG. 1 in which the push rod release means is fully enclosed within the door and an extension is provided for the push rod.

FIG. 5 shows a second embodiment of the invention in which release rod 37 is totally enclosed within closure 23 and is provided with an upward extension 37*a*.

As shown in FIG. 5 the latch sub-assembly 9 is affixed to the inner surface of door 23 at a position further removed from the bottom of door than is the case in FIG. 1. This is made possible by the provision of extension 37*a* which operatively engages release rod 37. A duplicate mounting bracket 24 is affixed to the lower inner surface of door 23 for guidance and containment of the extended release rod 37—37*a*. It will thus be seen that latch sub-assembly9 may be located at any desired position intermediate the bottom and top of door 23 by shortening or lengthening extension 37*a*. In such case the position of keeper pin 12 would be adjusted to align it with the opening 26 in mounting bracket 24.

Figure 6:
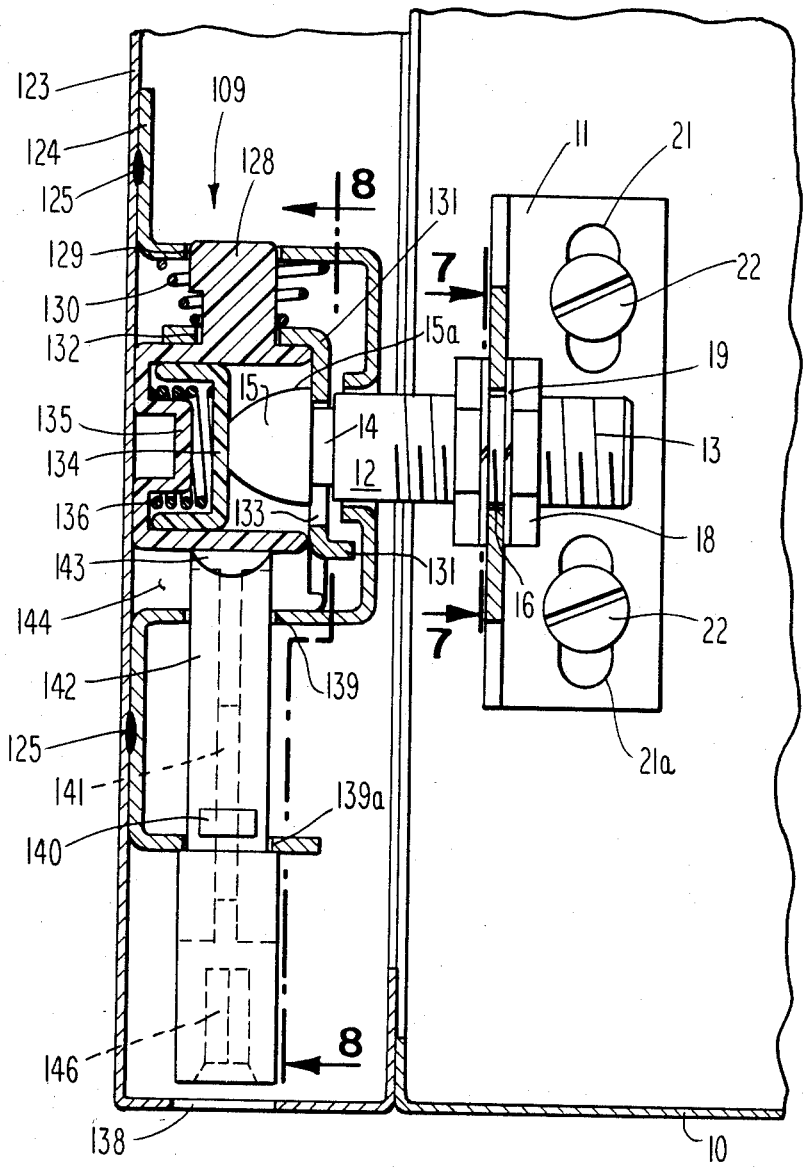
FIG. 6 is a view similar to FIGS. 1 and 2 showing the door in latched position but with a modified cam operated release mechanism.

FIG. 6 is a cross-section through closure 123 and enclosure 10 with closure 123 in the closed position in which latch plate 131 is in engagement with groove 14 and biasing means 136 is in compression by virtue of the lateral force against cup 134 which contacts the end of keeper pin 12. The operative elements of the latch sub-assembly bear 100 series numbers corresponding to the two-digit numbers of FIG. 1 but the release mechanism differs in its structure and mode of operation. This release mechanism comprises a rod 142 provided with a slot 141 and with stops 140. At its upper end rod 142 has a male camming surface 143 which engages V-shaped camming surface 144 formed in latch plate 131. At its lower end rod 142 is provided with a cavity 146 adapted to receive a suitable tool such as an Allen wrench for application of torque to release rod 142. The resulting turning action of rod 142 produces a lifting of latch plate 131 which in turn raises latch plate 131 out of engagement with groove 14. When this occurs cup 134 causes closure 123 to open through a bias force acting upon immovable pin 12.

Figure 8:
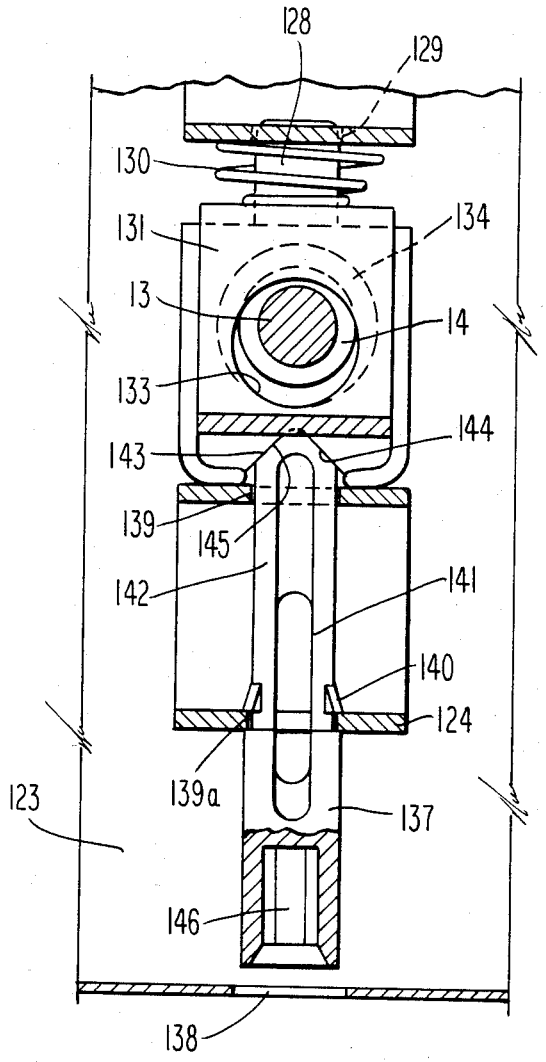
FIG. 8 is a sectional view taken along the line 8—8 of FIG. 6.

Since latch plate 131 is no longer in engagement with groove 14 it drops to a lower position as it slides down cam surface 15*a* when closure 123 opens. This latch plate lowering action takes place since the cam surface 143 returns to its original position as shown in FIG. 8 on the normal continued turning of release rod 142. Consequently, closure 123 and its associated latching mechanisms is in condition to once again latch when closure 123 is returned to its closed position.

Figure 7:
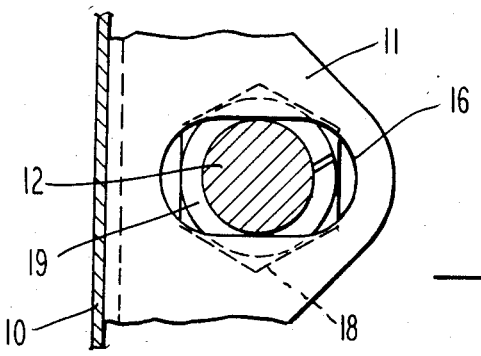
FIG. 7 is a sectional view taken along the line 7—7 of FIG. 6.

FIG. 7 is a cross-section taken along line 7—7 of FIG. 6. In this figure there is shown a wall cabinet 10 to which there is attached mounting bracket 11. An elongated opening in the web of mounting bracket 11 is shown at 16 within which keeper pin 12 is positioned and held firmly by lock washers 19 and 20 and threaded nuts 17 and 18.

FIG. 8 is a cross-section taken along line 8—8 of FIG. 6. In this figure triangular cam surface 143 at the top of release rod 142 is in contact with V-shaped camming surface 144 formed in latch plate 131. As rod 142 is rotated from its position in FIG. 6 to the position in FIG. 9 latch plate 131 is raised by the camming action of cam surface 143 against V-shaped camming surface 144.

Figure 9:
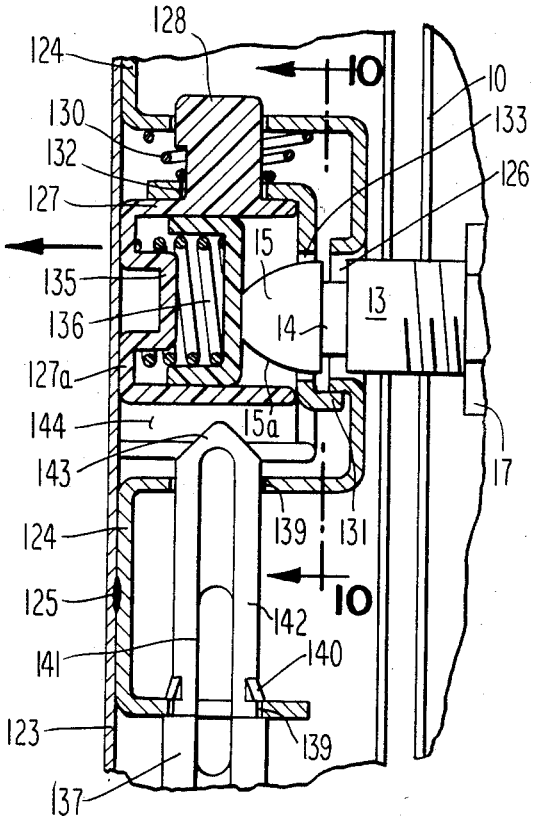
FIG. 9 is a view similar to FIG. 6 showing the door in the unlatched position.

FIG. 9 is a cross-section of the latching and release mechanisms with closure 123 in partially open position and with latch plate 131 in raised position and out of engagement with groove 14. Cam surfaces 143 and 144 are shown at maximum rise which position is only momentary as rod 142 is turned.

Figure 10:
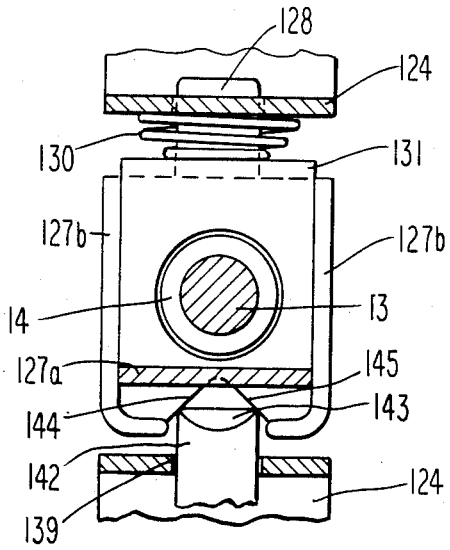
FIG. 10 is a sectional view taken along the line 10—10 of FIG. 9.

FIG. 10 is a cross-section taken on the line 10—10 of FIG. 9. This figure shows latch plate 131 in maximum raised position and shows the relative positions of cam surfaces 144 and 145 and the rotated position of rod 142 at such time.

OPERATION OF THE INVENTION

With keeper mounting bracket 11 properly adjusted and locked in position by tightening screws 22 and **22*a* and with the lateral position of keeper pin 12 properly adjusted and locked in position by tightening nuts 17 and 18 the keeper sub-assembly is completed and ready for latching door 23. Latch sub-assembly 9 is mounted on the inner surface of the front panel of door 23 and therefore moves toward or away from fixed keeper pin 12 as door 23 is closed or opened. When the cam surface on the nose 15 of keeper pin 12 is engaged by latch plate 31 the latch plate is raised thus compressing spring 30 to provide a bias force urging latch plate 31 toward latch pin 12. Further closing of door 23 results in a further raising of latch plate 31 until the latch plate reaches the inner end of the cam surface on nose 15 of latch pin 12. At this point further closing movement of door 23 results in latch plate 31 dropping into groove 14 in response to the bias generated in spring 30. Door 23 is now in locked position since no opening or closing movement of door 23 is possible until latch plate 31 is disengaged from groove 14. Such disengagement is accomplished by moving release rod 37 upwardly. This results in moving latch guide 27 and its associated biasing means 36 upwardly as shown in FIG. 3 Since latch guide 27 is in operative contact with the under surface of latch plate 31 there is a lifting action of latch plate 31 which results in disengaging latch plate 31 from groove 14 thus unlocking door 23 which is sprung open by the bias force generated in spring 36. At the same time latch plate 31 moves down in contact with the cam surface on the nose 15 of keeper pin 12 in response to the combined biasing actions of springs 30 and 36 on release of the upward force of rod 37 which force is no longer needed after latch plate 31 has been disengaged from groove 14 and door 23** has started to open.

In the embodiment of the invention shown in FIG. 5 release rod 37 is completely enclosed within door 23 and is provided with an extension **37*a*. However, the unlatching action is the same as described above except that release rod 37, 37*a* is operated by a tool which is inserted through opening 38**.

Other modifications of the blind latching system disclosed above are possible, all within the spirit and scope of this invention. Therefore, this disclosure is not intended to limit the present invention to the specific embodiments described above.

We claim:

1. In a blind latching system for cabinet enclosures having a closure element movable between open and closed positions and a fixed cabinet and the like, the combination of a keeper sub-assembly adapted for attachment to said cabinet or the like, a latch sub-assembly adapted for attachment to an inner surface of said closure element and including a latch positioned for cooperative latching action with said keeper sub-assembly, and release means operatively positioned relative to said latch for unlatching said latch sub-assembly from said keeper sub-assembly, said latch sub-assembly being provided with a first biasing means positioned to act on said latch and with a second biasing means positioned to contact and to act on said keeper sub-assembly on movement of said closure element to said closed position, said latch sub-assembly including a movable latch guide positioned to operatively engage said latch and within which said second biasing means is contained.

2. The apparatus of claim 1 in which the keeper sub-assembly includes a bracket having adjustable mounting means for adjustably mounting said bracket on said fixed cabinet.

3. The apparatus of claim 2 in which said bracket includes a sidewall perpendicular to the surface of said cabinet, an opening in said sidewall, and a keeper pin projecting through said opening.

4. The apparatus of claim 3 in which said keeper pin includes a tapered nose and a groove rearward of said nose for receiving said latch.

5. The apparatus of claim 4 in which said latch is movable into said keeper-pin groove by the action of said first biasing means.

6. The apparatus of claim 1 in which said first and second biasing means are coil compression springs and in which the coil of the first biasing means has a center axis which is substantially at right angles to the central axis of the coil of said second biasing means.

7. The apparatus of claim 6 in which movement of said release means in response to force applied thereto causes movement of said latch guide and latch and compresses the coil of said first biasing means.

8. The apparatus of claim 1 in which the release means comprises a rod which is substantially contained within said closure element.

9. The invention of claim 8 in which the release means comprises a rotatable rod terminating at its upper end in cam means for lifting said latch on rotation of said release means.

10. A latch mechanism comprising a keeper assembly and a latch assembly, components of which are mounted on different housing members, one of which is fixed and the other of which is pivotally movable between open and closed positions;

A. said keeper assembly comprising:

(a) a cylindrical keeper pin having at its forward end a nose portion having a camming surface;

(b) said keeper pin having a reduced diameter portion immediately rearwardly of said nose portion, said reduced diameter portion forming a circumferential slot for receiving a latch member;

B. said latch assembly comprising:

(a) a latch plate member positioned generally perpendicular to the axis of said keeper pin when said pivotal member is in closed position, said plate member having a circular hole therethrough of a size and shape to receive said keeper pin;

(b) a latch member movably mounted at an edge of said hole;

(c) a first compression coil biasing spring positioned to bias said latch member radially inwardly relative to said hole to a limit position such that said latch member obstructs an edge portion of said hole, whereby when said pivotal housing member is moved to closed position said nose portion of said keeper pin enters into said hole of said latch plate and cams said latch member radially outwardly against the action of said first biasing spring until said nose portion passes, whereupon said latch member in response to the force of said first biasing spring enters the circumferential slot of said keeper pin, thereby to effect latching of said latch mechanism;

(d) a second compression coil biasing spring mounted coaxially with said keeper pin and positioned to be compressed by said keeper pin when said pivotal member is in closed position;

(e) a cup retaining one end of said coil of said second biasing spring, said cup being mounted for movement along the projected axis of said keeper pin; and (f) release means for moving said latch member radially outwardly against the action of said first biasing spring, thereby to allow said compressed second biasing spring to expand, thereby to move said pivotal housing member in the opening direction.

* * * * *